US009301896B2

(12) United States Patent
Hsieh

(10) Patent No.: US 9,301,896 B2
(45) Date of Patent: Apr. 5, 2016

(54) RISE ASSISTING STRUCTURE

(71) Applicant: Kuan-Fu Hsieh, Taipei (TW)

(72) Inventor: Kuan-Fu Hsieh, Taipei (TW)

( * ) Notice: Subject to any disclaimer, the term of this patent is extended or adjusted under 35 U.S.C. 154(b) by 47 days.

(21) Appl. No.: 14/231,621

(22) Filed: Mar. 31, 2014

(65) Prior Publication Data

US 2015/0272798 A1 Oct. 1, 2015

(51) Int. Cl.

| | |
|---|---|
| ***A61G 5/14*** | (2006.01) |
| ***A61G 7/10*** | (2006.01) |
| *A61G 5/08* | (2006.01) |
| *A61G 5/12* | (2006.01) |

(52) U.S. Cl.

CPC ..... *A61G 5/14* (2013.01); *A61G 7/1019* (2013.01); *A61G 2005/0825* (2013.01); *A61G 2005/128* (2013.01)

(58) Field of Classification Search

CPC ..... Y10S 297/10; A61G 5/14; A61G 7/1019
USPC ..... 297/DIG. 10
See application file for complete search history.

(56) References Cited

U.S. PATENT DOCUMENTS

| | | | | | |
|---|---|---|---|---|---|
| 3,787,089 | A * | 1/1974 | Wrethander | A61G 5/14 | 280/250.1 |
| 4,690,457 | A * | 9/1987 | Poncy | A61G 5/14 | 297/337 |
| 4,884,841 | A * | 12/1989 | Holley | A61G 5/14 | 297/331 |
| 4,929,022 | A * | 5/1990 | Geraci | A61G 5/14 | 297/183.9 |
| 4,979,726 | A * | 12/1990 | Geraci | A61G 5/14 | 297/313 |
| 5,240,276 | A * | 8/1993 | Coombs | A61G 5/08 | 280/647 |
| 5,375,913 | A * | 12/1994 | Blanchard | A61G 5/14 | 297/310 |
| 5,513,867 | A * | 5/1996 | Bloswick | A61G 5/14 | 280/250.1 |
| 6,851,751 | B1 * | 2/2005 | Romero | A61G 5/14 | 280/250.1 |
| 8,556,347 | B2 * | 10/2013 | Lin | A61G 5/14 | 297/334 |
| 2006/0284462 | A1 * | 12/2006 | Cheng | A61G 5/14 | 297/326 |
| 2008/0038107 | A1 * | 2/2008 | Henshaw | A61G 7/1007 | 414/816 |
| 2012/0074668 | A1 * | 3/2012 | Braaten | A61G 5/14 | 280/304.1 |
| 2014/0252747 | A1 * | 9/2014 | Hermes | A61G 5/1062 | 280/291 |

* cited by examiner

*Primary Examiner* — Ryan Kwiecinski
(74) *Attorney, Agent, or Firm* — Leong C. Lei

(57) ABSTRACT

A rise assisting structure includes a main body, a seat unit, two operation bars, and two support units. The seat unit is pivotally connected, at one side thereof, to the main body. The operation bars are pivotally mounted to the main body. The operation bars are provided at one end thereof with a step board arranged therebetween. The support units are each of an elastic extendable/retractable arrangement. When the step board is treaded down, the operation bars provide a torque in a way similar to a seesaw and the support units provide an elastically-support upward-pushing effect to raise up the seat unit so as to allow a user, with or without the assistance of an attendant person, to rise and stand up easily.

6 Claims, 10 Drawing Sheets

RISE ASSISTING STRUCTURE

TECHNICAL FIELD OF THE INVENTION

The present invention generally relates to a rise assisting structure, and more particularly to a structure that enables a user to easily and conveniently rise and stand up.

DESCRIPTION OF THE PRIOR ART

The elder often suffers deterioration of the functionality of the body and the waist and legs may be weak. This leads to insufficiency of supporting force in the knee joints that may cause falling or being difficult to rise and stand up by oneself Consequently, other people's assistance is often needed for holding and supporting.

Prior art regarding structure for assisting rising and sitting is known, such as Taiwan Patent No. 545236 and Utility Models M249633 and M255005, which are all operated with electrical power. Since the electrical systems are of complicated structures, expensive costs, great difficulty of installation, and great weights and thus are adverse to manufacture and market for the manufacturers so that the general consumers may not afford such devices. Thus, these result in an increase of economic burden of users, excessively greater weight, and being not foldable.

Additional reference is made to Taiwan Patent Nos. 353940 and 483328. These patents disclose structures that are not operated with electrical power, but they also have drawbacks of having complicated structures and being not foldable. Particularly, these prior art documents do not disclose a structure featuring the present invention that when a step board is treaded down, operation bars provides a torque in a way similar to a seesaw and support units provides an elastically-supported upward-pushing effect to raise up a seat unit.

SUMMARY OF THE INVENTION

An object of the present invention is to provide a rise assisting structure that allows a user to easily and conveniently rise and stand up.

To achieve the above object, the present invention comprises a main body, a seat unit, two operation bars, and two support units, wherein the seat unit is pivotally connected, at one side thereof, to the main body, to be rotatable about pivot points defined at the pivot connection. The operation bars are pivotally connected to the main body in such a way that two ends of each of the operation bars are rockable. The operation bars are provided, at one end thereof, with a step board arranged therebetween. The support units are each of an elastic extendable/retractable arrangement. The support units are each connected, at one end thereof, to the seat unit. The support units are respectively and pivotally connected, at an opposite end thereof, to the operation bars at an opposite end thereof When the step board is treaded down, the operation bars provide a torque and the support units provide an elastically-support upward-pushing effect to raise up the seat unit so as to allow a user, with or without the assistance of an attendant person, to rise and stand up easily.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
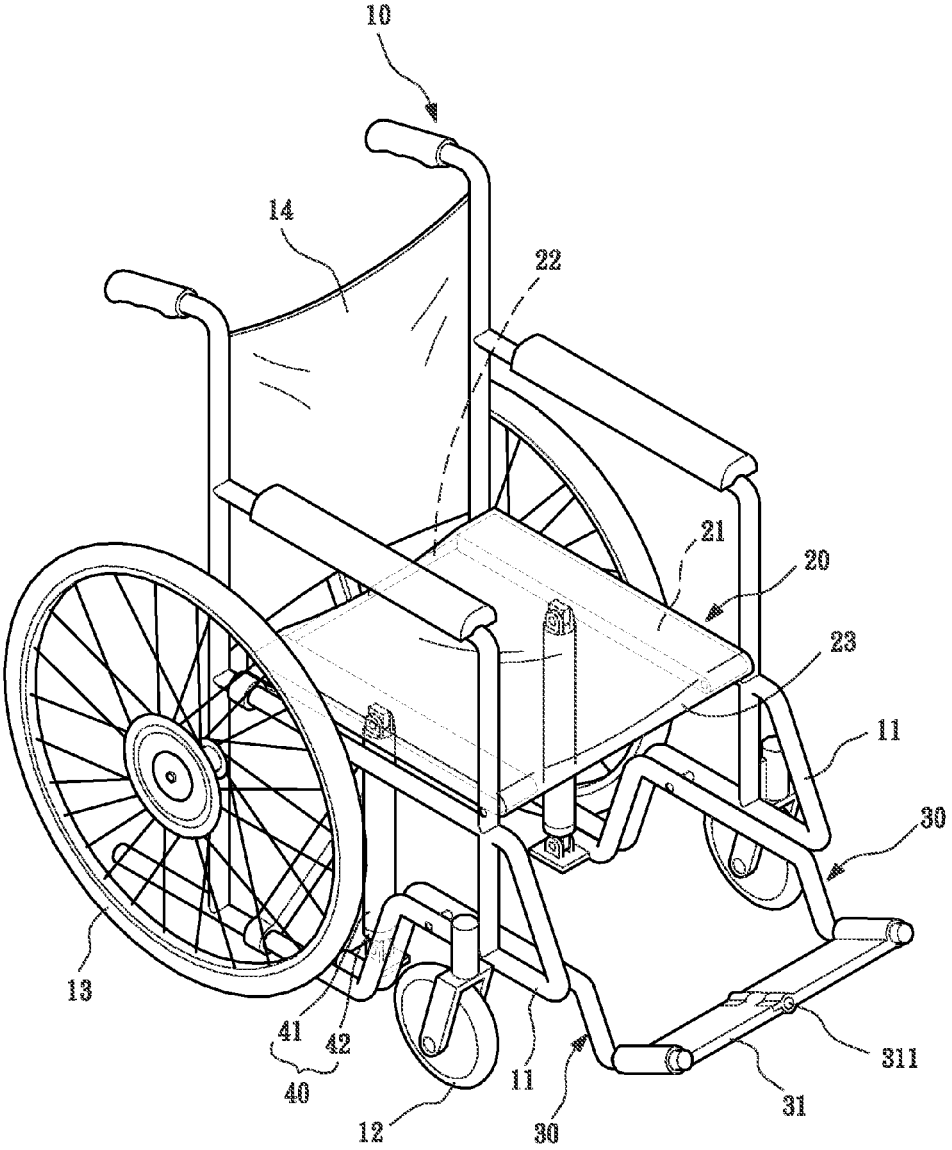
FIG. 1 is a perspective view of the present invention.
Figure 2:
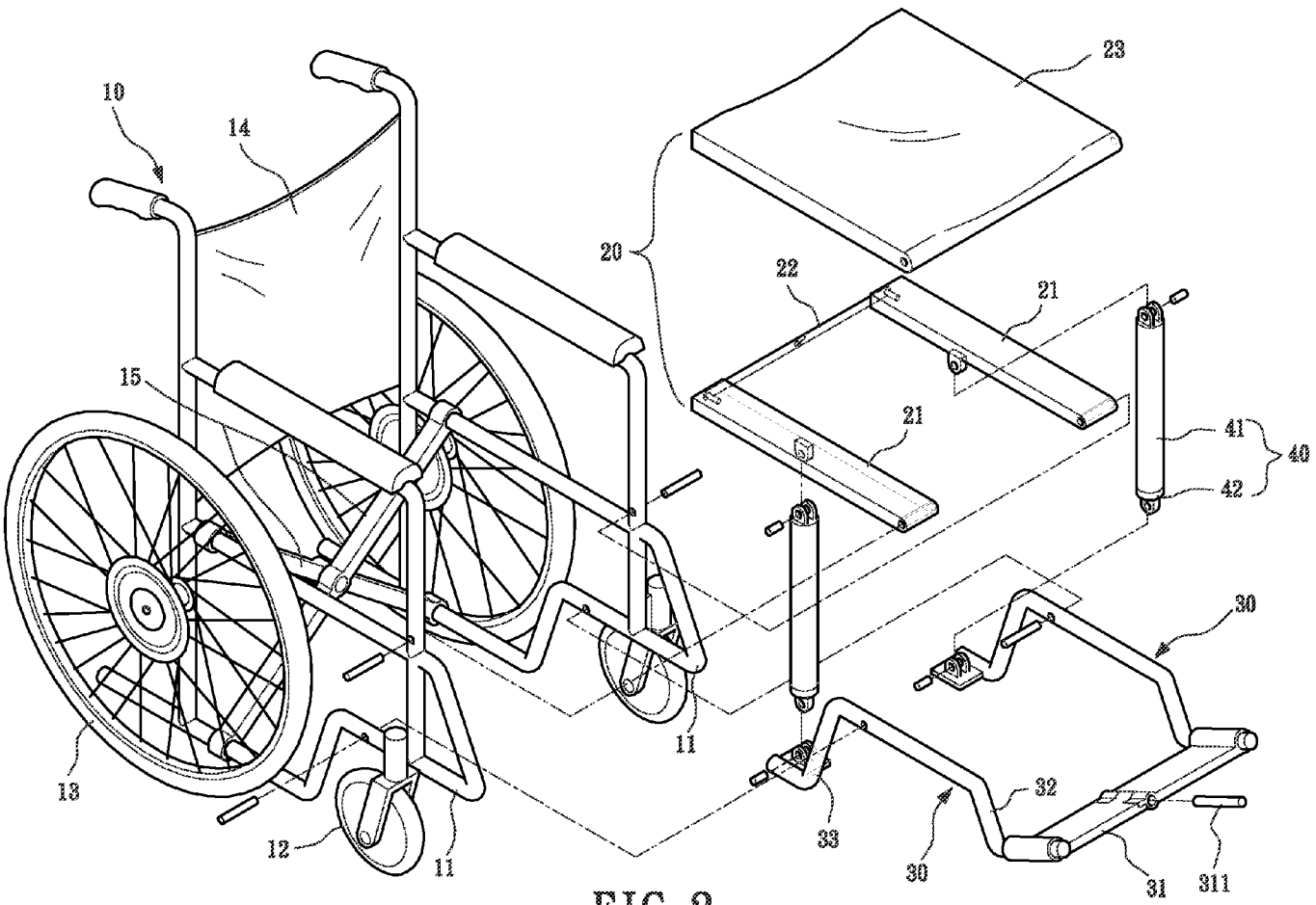
FIG. 2 is an exploded view of the present invention.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring to FIGS. 1, 2, 3, and 4, the present invention comprises a main body 10, a seat unit 20, two operation bars 30, and two support units 40.

In the instant embodiment, the main body 10 comprises a wheelchair structure, which comprises two opposite frames 11. Each of the frames 11 is provided with a large and a small wheels 12, 13. Arranged between the frames 11 include a back support 14 made of a flexible material and two expansion/collapse brace bars 15. Each of the expansion/collapse brace bars 15 has two ends movably and respectively mounted to the frames 11 in such a way that the expansion/collapse brace bars 15 are pivotally connected to each other at middle positions thereof. Further, with the back support 14 being flexible and thus deformable, the main body 10 is allowed to selectively expand and collapse.

The seat unit 20 is pivotally connected, at one side thereof, to the frames 11 of the main body 10 so as to be rotatable about pivot points defined at the pivot connection. The seat unit 20 comprises two bearing racks 21, a connection bar 22, and a seat 23. The bearing racks 21 are arranged opposite to each other by setting a predetermined distance therebetween. The connection bar 22 is connected between the bearing racks 21 and comprises a collapsible structure formed at a middle portion thereof. The seat 23 is made of a flexible material and encloses the bearing racks 21 to form a cushion on which a user may sit. One side of the seat 23 and an end of each of the bearing racks 21 are collectively coupled to the frames 11 of the main body 10 through the pivotal connection so that by means of the collapsible structure of the connection bar 22 and deformability of the seat 23 achieved with the flexibility thereof, the frames 11 of the main body 10 are allowed to collapse inwardly and expand outwardly.

The operation bars 30 are pivotally and respectively connected to the frames 11 of the main body in such a way that two ends of each of the operation bars 30 are rockable like a seesaw. The operation bars 30 are connected, at one end thereof, to a step board 31 arranged therebetween. Each of the operation bars 30 comprises two bend sections 32, 33 respectively arranged at the two ends thereof for spatial arrangement for mounting to the frames 11 and also for improving torques generated in the rocking of the operation bar 30. The step board 31 is made in a two-piece arrangement having a connection at a center thereof A pivot pin 311 is set to extend through the center of the step board 31 to joint the two pieces for forming a collapsible structure so as to allow for the inward collapse and outward expansion of the frames 11 of the main body 10.

Figure 3:
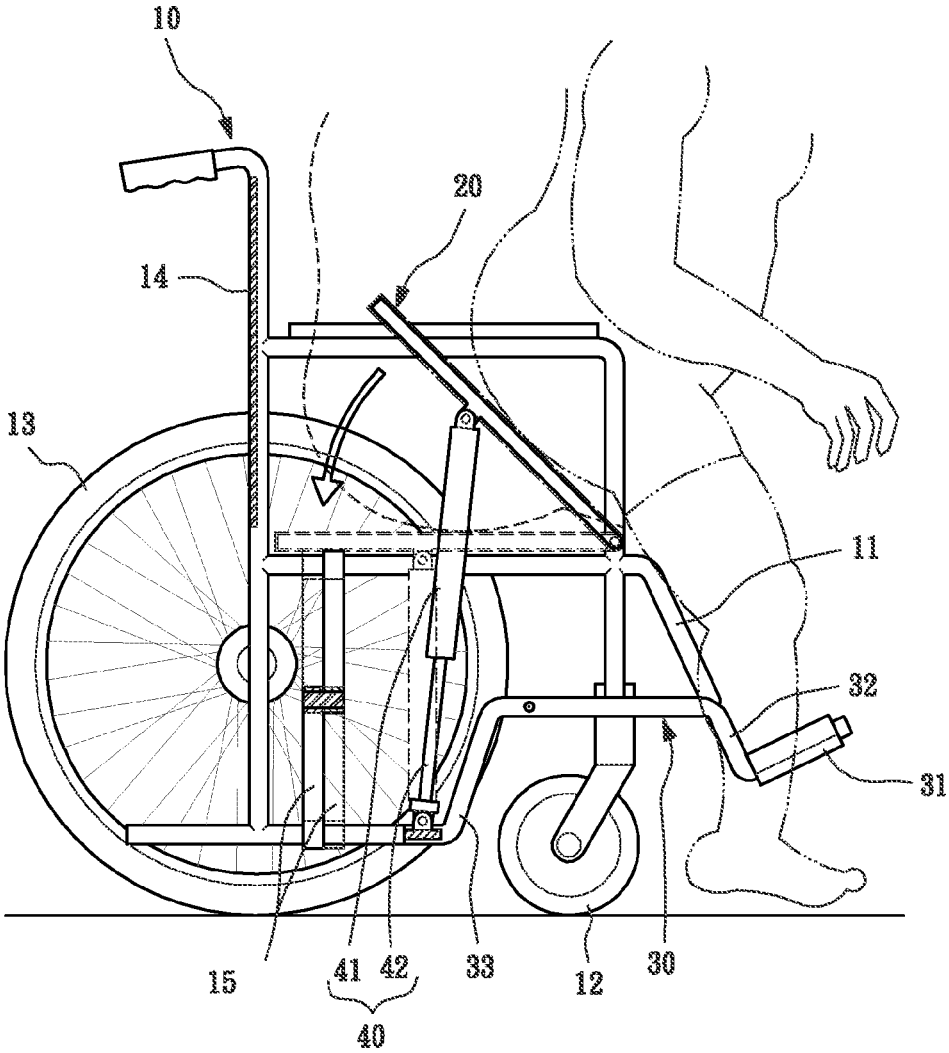
FIG. 3 is a side elevational view demonstrating an example of the present invention assisting a user to sit down.
Figure 4:
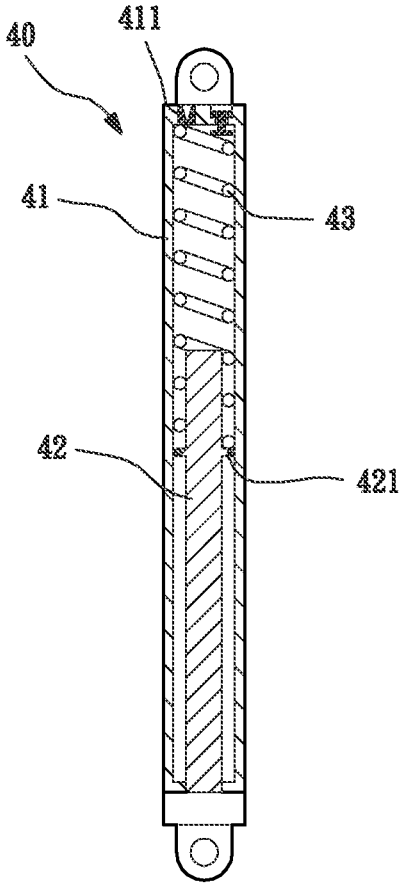
FIG. 4 is a cross-sectional view showing a support unit according to the present invention.
Figure 6:
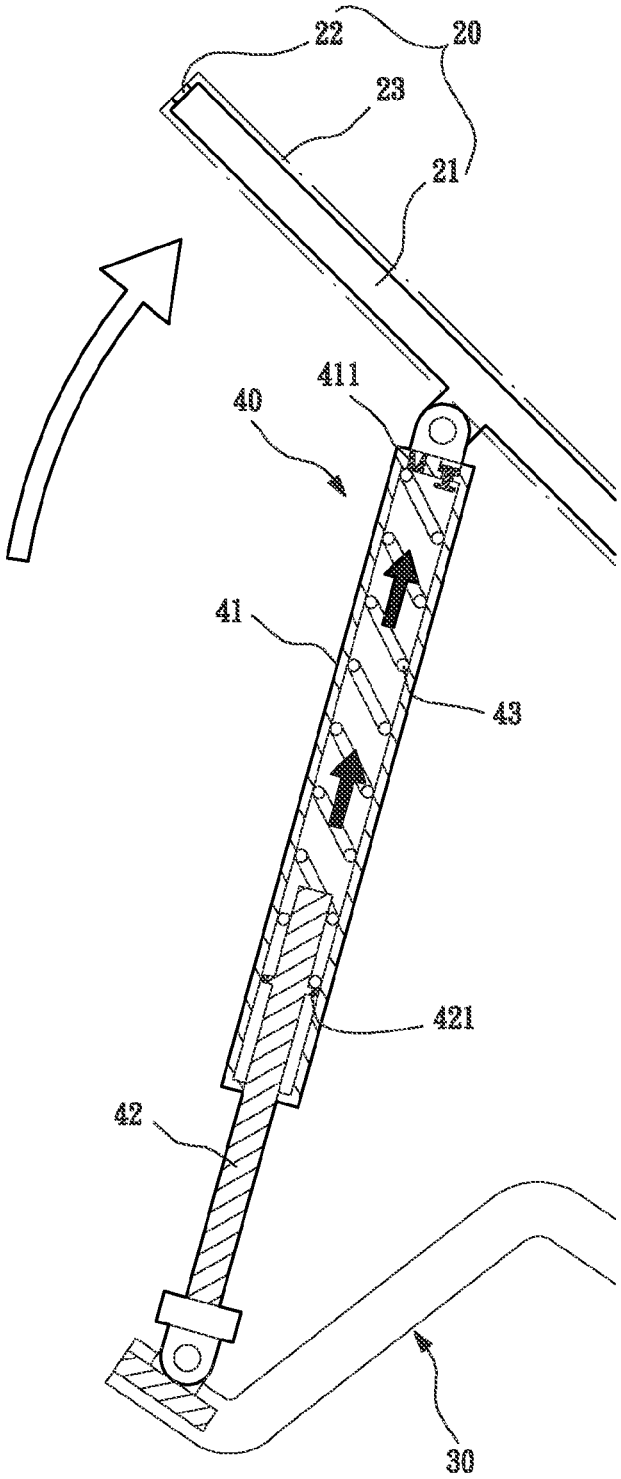
FIG. 6 is a cross-sectional view illustrating an example of use of the support unit according to the present invention.

Referring to FIGS. 3, 4, and 6, the support units 40 are each made in an elastic extendable/retractable arrangement. The support units 40 are respectively and pivotally connected, at one end thereof, to undersides of the bearing racks 21 of the seat unit 20 and the support units 40 are also respectively and pivotally connected, at an opposite end thereof, to the operation bars 30 at an opposite end thereof. The support units 40 each comprise a first rod 41, a second rod 42, and a first elastic body 43. An end of the first rod 41 is pivotally connected to the underside of the corresponding bearing rack 21 of the seat unit 20. The first rod 41 is a hollow body that defines a receiving space therein. An end of the second rod 42 is pivotally connected to the opposite end of the corresponding operation bar 30 and the second rod 42 is received in the first rod 41. The second rod 42 has an outer circumferential surface on which a circumferentially-extending first stop 421 is formed at a predetermined location and the first stop 421 is located inside the first rod 41. In the instant embodiment, the first elastic body 43 comprises a compression spring and the first elastic body 43 is received in the first rod 41 in such a way that the first stop 421 is supported on an end of the first elastic body 43. In a condition that the first rod 41 is not subjected to the action of an external force, the first elastic body 43 provides a force to support the first rod 41 and the second rod 42 in an extended condition so as to make the seat unit 20 incline by a predetermined angle. The first stop 421 provides constraining to prevent the first rod 41 and the second rod 42 from separating from each other.

In an embodiment, the first rod 41 is additionally provided with an air valve 411, whereby when the first rod 41 and the second rod 42 are moved to a retracted condition, air that is contained in the first rod 41 and thus compressed is allowed to release through the air valve 411. Cushioning can be achieved during the retraction by compression of the first elastic body 43 so as to accomplish slot and progressive retraction and collapse. Further, when the first rod 41 and the second rod 42 are moved toward the expanded condition, air that is outside the first rod 41 is allowed to enter the first rod 41 through the air valve 411.

Referring to FIGS. 3 and 4, when a user sits down on the seat unit 20 of the present invention, a downward force is applied to the support units 40 to cause the first rods 41 and the second rods 42 to gradually retract and collapse so as to provide a cushioning effect to the user sitting down onto the seat unit 20, allowing the user to sit, in an easy and slow motion, on the seat unit 20.

Figure 5:
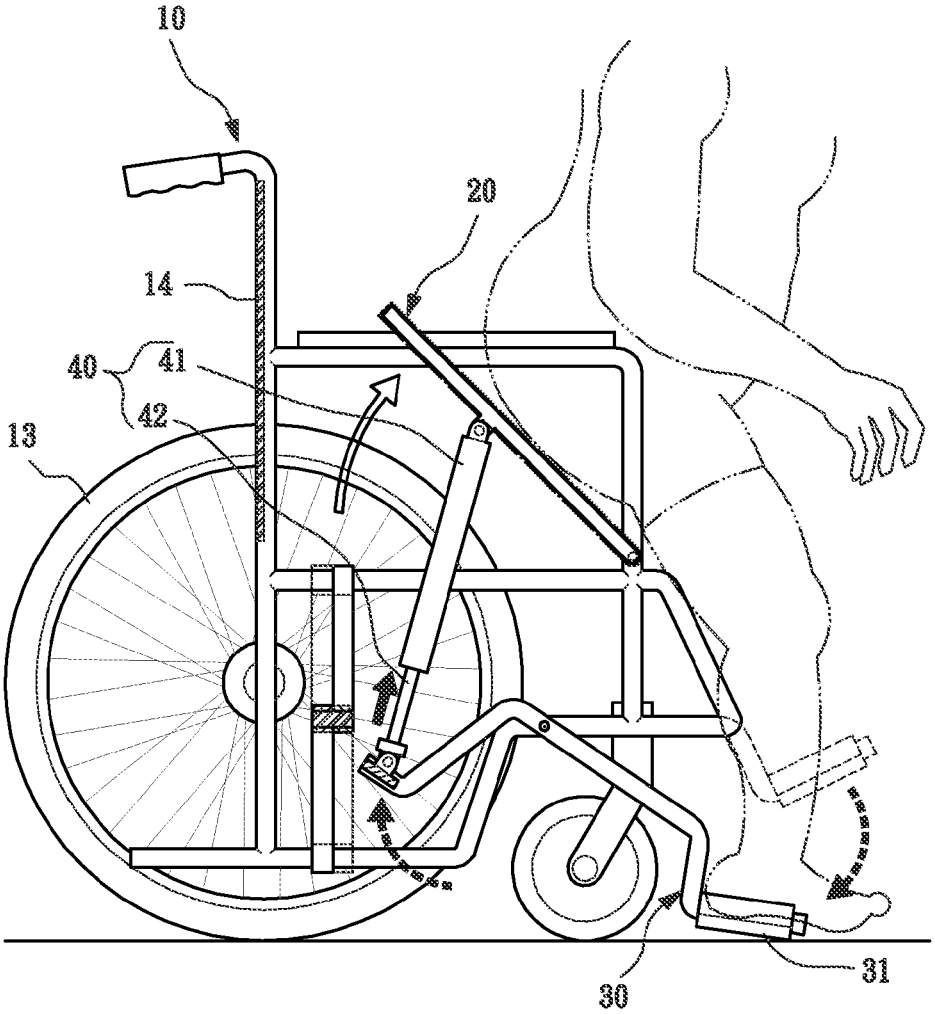
FIG. 5 is a side elevational view demonstrating an example of the present invention assisting a user to rise and stand up.

Referring to FIGS. 5 and 6, when the user wishes to rise and stand up, the user treads down the step board 31 to cause the opposite end of each of the operation bars 30 to rock up by inducing a seesaw like torque. With the user who sits on the seat unit 20 rising and gradually reducing the force induced by the body weight, the support units 40 are caused to operate by gradually extend up the first rods 41 to provide an elastically-supported upward-pushing effect that raises the seat unit 20 to allow the user, with or without the assistance of an attendant person, to rise and stand up easily and also to prevent the user from being hurt resulting from unexpected falling back due to weakness of waist and/or legs.

Figure 7:
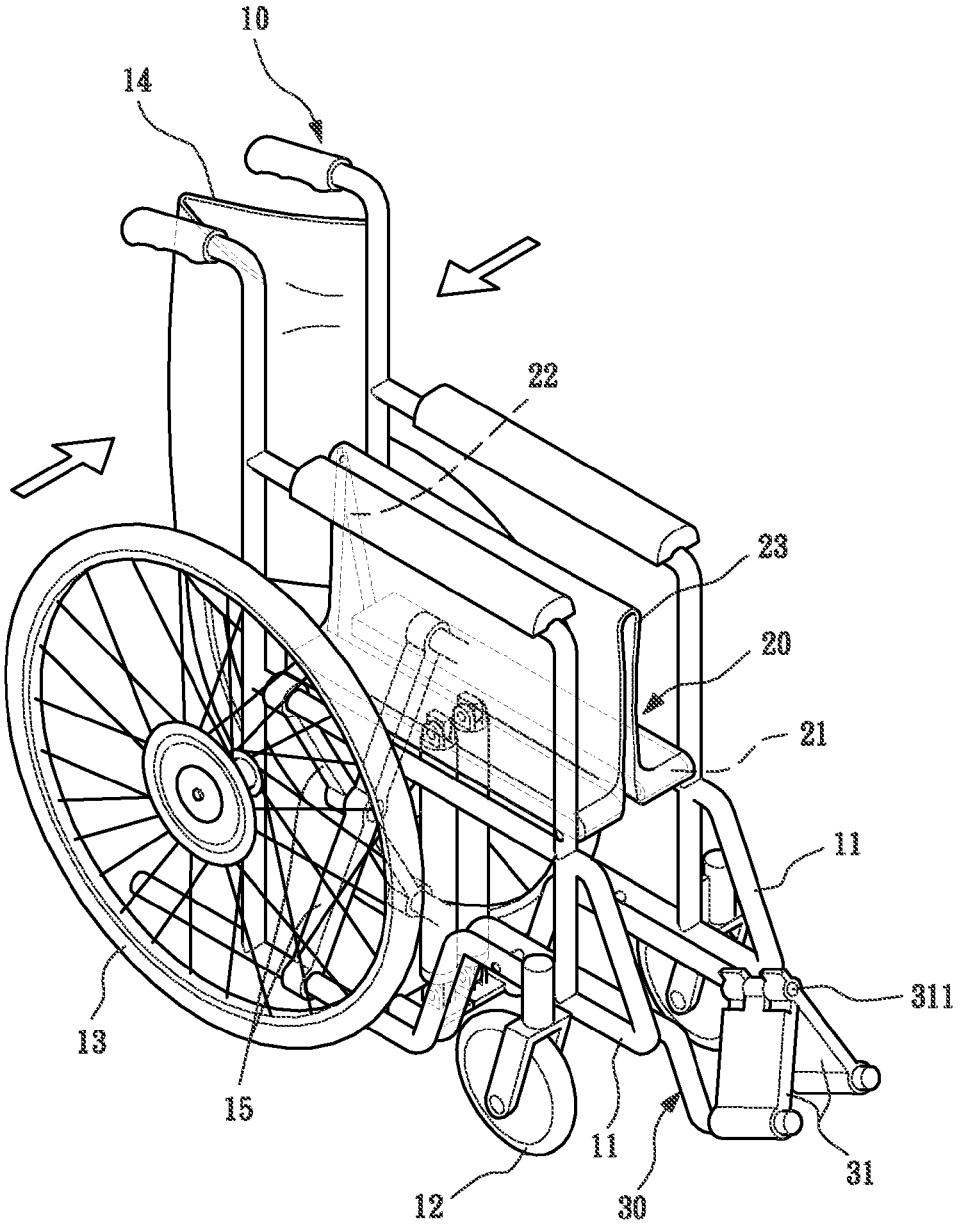
FIG. 7 is a perspective view showing collapse of the present invention.

Referring to FIG. 7, the present invention features easy collapsibility and possesses the advantages of reducing weight and saving space.

Figure 8:
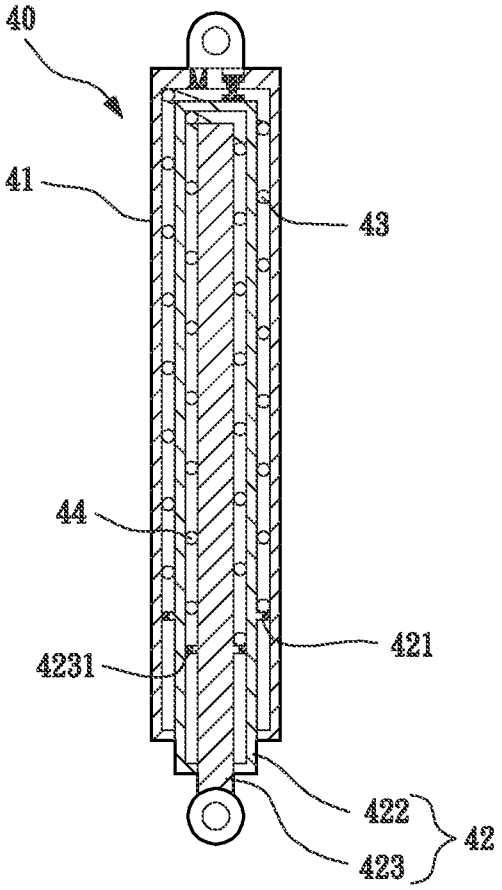
FIG. 8 is a cross-sectional view showing a support unit according to another embodiment of the present invention.
Figure 9:
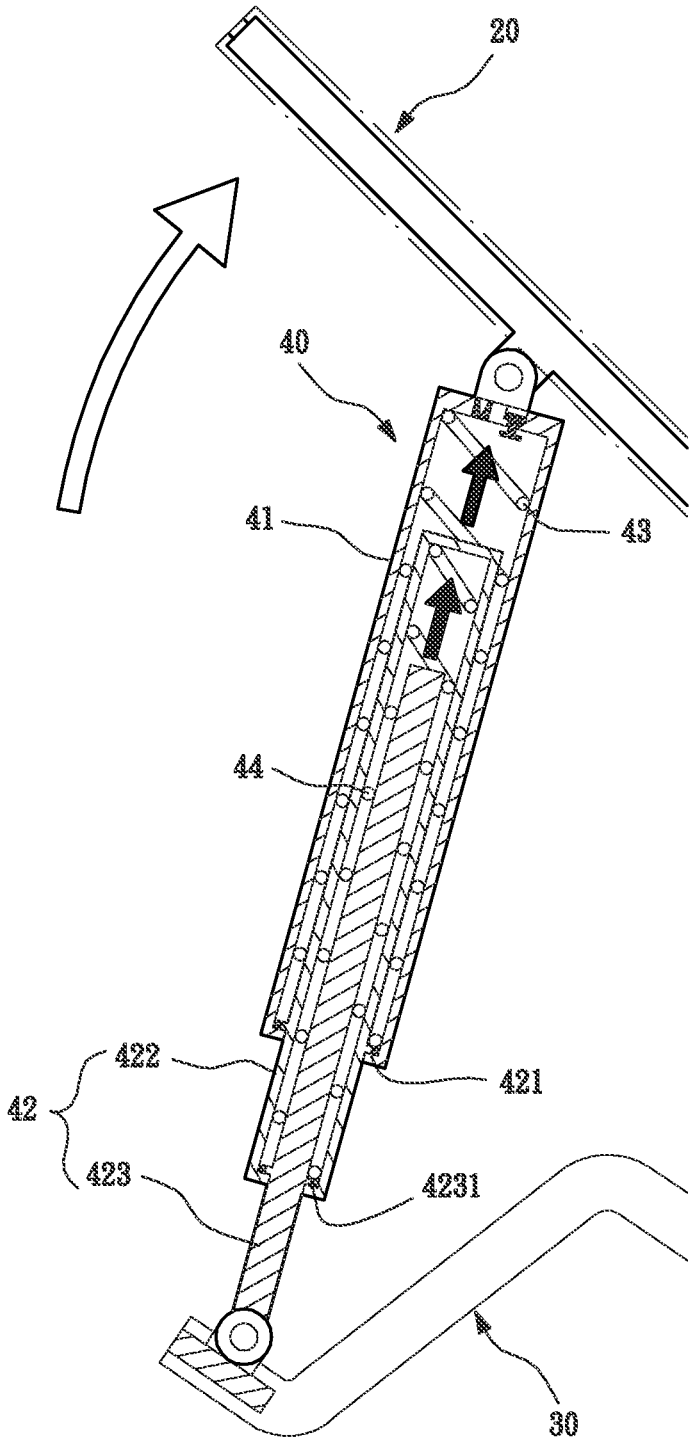
FIG. 9 is a cross-sectional view illustrating an example of use of the support unit according to said another embodiment of the present invention.

Referring to FIGS. 8 and 9, in an embodiment of the present invention, the support units 40 each further comprise a second elastic body 44. The second rod 42 is made up of a third rod 422 and a fourth rod 423 with the first stop 421 formed on and circumferentially around an outer circumferential surface of the third rod 422. The fourth rod 423 has an end pivotally connected to the opposite end of the corresponding one of the operation bars 30 and the fourth rod 423 is received in the third rod 422, which in this case, is hollow. The fourth rod 423 is provided, on an outer circumferential surface thereof at a predetermined location, with a second stop 4231 and the second stop 4231 is located in the third rod 422. The second elastic body 44 of the instant embodiment is a compression spring. The second elastic body 44 is received in the third rod 422 with the second stop 4231 supporting an end of the second elastic body 44. Such an arrangement helps increase the elastically-supported upward-pushing force of the support unit 40.

Figure 10:
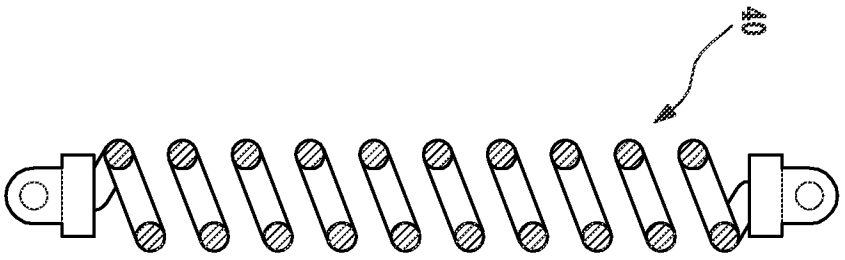
FIG. 10 is a cross-sectional view showing a support unit according to a further embodiment of the present invention.

Referring to FIG. 10, in an embodiment of the present invention, the support units 40 comprise a compression spring.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A rise assisting structure, comprising:

a main body;

a seat unit, which is pivotally connected, at one side thereof, to the main body, so as to be rotatable about pivot points defined at the pivot connection;

two operation bars, which are each pivotally connected to the main body in such a way that two ends of each of the operation bars are rockable, the operation bars being connected, at one end thereof, to a step board;

two support units, which are each of an elastic extendable and retractable arrangement, the support units being each pivotally connected, at one end thereof, to the seat unit, the support units being respectively and pivotally connected, at an opposite end thereof, to an opposite end of the operation bars;

wherein the seat unit comprises two bearing racks, a connection bar, and a seat, the bearing racks being opposite to and spaced from each other with a predetermined spacing distance therebetween, the connection bar being connected to the bearing racks and comprising a collapsible structure formed at a middle portion thereof, the seat being made of a flexible material enclosing the bearing racks, one side of the seat and an end of each of the bearing racks being collectively coupled to the main body through the pivot connection.

2. The rise assisting structure according to claim 1, wherein the operation bars each comprises two bend sections respectively arranged at the two ends thereof.

3. The rise assisting structure according to claim 1, wherein the step board is formed in a two-piece arrangement having a connection at a center thereof, a pivot pin being received through the center of the step board to joint the pieces to form a collapsible structure.

4. The rise assisting structure according to claim 1, wherein the support units each comprise a first rod, a second rod, and a first elastic body, the first rod being pivotally connected, at one end thereof, to the seat unit, the first rod being of a hollow structure, the second rod being pivotally connected, at one end thereof, to the operation bar, the second rod being received in the first rod, the second rod comprising a circumferentially extending first stop, the first stop being received in the first rod, the first elastic body being received in the first rod with the first stop supporting an end of the first elastic body.

5. The rise assisting structure according to claim 4, wherein the support units each comprise a second elastic body, the second rod comprising a third rod and a fourth rod, the first stop being circumferentially formed on an outer circumferential surface of the third rod, an end of the fourth rod being pivotally connected to the operation bar, the fourth rod being received in the third rod, the fourth rod having an outer circumferential surface on which a second stop is formed at a predetermined location, the second stop being received in the third rod, the second elastic body being received in the third rod with the second stop supporting an end of the second elastic body.

6. The rise assisting structure according to claim 1, wherein the support units comprise compression springs.

* * * * *